US005588163A

United States Patent [19]

Miller

[11] Patent Number: 5,588,163

[45] **Date of Patent: *Dec. 31, 1996**

[54] SUPPORT DECK FOR MATTRESS OR SEAT

[76] Inventor: John E. Miller, 1016 Monroe St., Tupelo, Miss. 38801

[ * ] Notice: The term of this patent shall not extend beyond the expiration date of Pat. No. 5,231,709.

[21] Appl. No.: 444,685

[22] Filed: May 19, 1995

Related U.S. Application Data

[63] Continuation-in-part of Ser. No. 66,993, May 25, 1993, which is a continuation-in-part of Ser. No. 588,351, Sep. 26, 1990, Pat. No. 5,231,709.

[51] Int. Cl.[6] ..... A47C 17/02

[52] U.S. Cl. ..... 5/13; 5/188

[58] Field of Search ..... 5/659, 186.1, 188, 5/13, 12.1, 14; 297/452

[56] References Cited

U.S. PATENT DOCUMENTS

| | | | |
|---|---|---|---|
| 802,415 | 10/1905 | Sleight | 5/188 |
| 984,001 | 2/1911 | Ingraham | 5/188 |
| 1,247,024 | 11/1917 | Smith | 5/188 |
| 1,300,664 | 4/1919 | Smith | 5/188 |
| 2,365,111 | 12/1944 | Russell | 5/188 |
| 2,581,611 | 1/1952 | Szulce | 5/188 |
| 2,742,653 | 4/1956 | Woller . | |
| 2,851,698 | 9/1958 | Barabas . | |
| 4,476,594 | 10/1984 | McLeod . | |
| 4,523,342 | 6/1985 | Poovey | 5/13 |
| 4,541,133 | 9/1985 | Reiss | 5/13 |

*Primary Examiner*—Flemming Saether
*Attorney, Agent, or Firm*—William E. Mouzavires

[57] ABSTRACT

A support deck for a sofa bed having a plurality of support members interconnected at joints such that when a force is applied to one side of the deck the deck will yield but when a force is applied to the opposite side, the deck will be relatively unyieldable.

15 Claims, 10 Drawing Sheets

SUPPORT DECK FOR MATTRESS OR SEAT

This application is a continuation-in-part of my prior co-pending application Ser. No. 08/066,993 filed May 25, 1993, which in turn is a continuation-in-part of application Ser. No. 07/588,351 filed Sep. 26, 1990, now U.S. Pat. No. 5,231,709.

BACKGROUND OF THE INVENTION

The present invention generally relates to method and apparatus for providing a support deck for a mattress or a seat. The support deck of the present invention is particularly suitable for use in sofa beds although the invention need not be limited thereto. In the past, sofa bed mattress decks have been made with link fabrics or polypropylene which are attached to an outside frame with hooks or helicals. The link fabric decks have an inherent flaw because they are comprised of a grid of wires which are free to pivot or yield thus offering little resistance when a person sits or rests on the unfolded sofa bed, this effect is known in the industry as "hammocking". The sofa bed decks made from polypropylene also suffer from the same inherent flaw in that they consist of a canvas-type material attached to a frame with hooks or helicals which simply are not resilient or strong enough to provide proper support for a person sitting or resting on the sofa bed.

Another problem with the prior art is what is known in the industry as "crowning". Crowning occurs when the sofa bed mattress, after having been folded and recessed back into the sofa, is so thick as to push upwards against the sofa bed deck causing a bulge because the sofa bed deck is not strong enough to restrain the compacted mattress. This bulge then makes it impossible for seat cushions to lay flat on the sofa, a condition known in the industry as cushion "smiling". Sitting on a sofa with "smiling" cushions is also unpleasant since one sits on a firm bulge of mattress almost teetering back and forth.

The present invention involves the use of a unique interlocking grid system in a support deck in order to eliminate mattress "hammocking", "crowning" and seat cushion "smiling" in sofa beds.

OBJECTS OF THE INVENTION

An object of the present invention is to provide a unique deck structure that may be used in sofa beds or other seating or bedding support systems.

Another object of the present invention is to provide a novel sofa bed mattress deck that eliminates the problem of "hammocking" identified above. Another object of the present invention is to provide a mattress deck that will also eliminate mattress "crowning" and cushion "smiling".

It is a further object of the present invention to provide a sofa bed mattress deck that can accommodate a thicker or longer sofa bed mattress yet at the same time provide for neat and compact storage or folding of the mattress back in the sofa bed.

It is another object of the present invention to provide a sofa bed mattress deck that when fully closed not only enables a sofa cushion to lay flat on it but also provides a flat and soft seat penetration as in a conventional sofa with standard sprung seats.

A further object of the present invention is to provide a sofa bed mattress deck that will achieve the above objects and yet is relatively inexpensive to manufacture.

SUMMARY OF THE INVENTION

The present invention is embodied in a grid attached to a frame, the grid being formed by wire-like members joined together such that the grid when pushed or forced from one side resists and maintains its flat surface (i.e. it is in the locked position) but when pushed or forced from the other side yields. As a result when the sofa bed is unfolded, a firm mattress is provided that contours to the user's body without excessive sagging. When folded and stored, the deck provides a flat surface upon which the sofa bed cushions can be placed without smiling or bulging upward. In this condition, the mattress is pushing upward and outward against the side of the deck that is in a locked position which resists the force of the mattress.

The support provided for a person sitting on the sofa bed when in the sofa mode simulates that of a standard sofa that has a sprung seat, due to the fact that the deck grid while locked against upward movement will yield in downward movement caused by the person's weight.

DRAWINGS

Other objects and advantages of the present invention will become apparent from the detailed description below taken in conjunction with the attached drawings in which.

DETAILED DESCRIPTION

Figure 1:
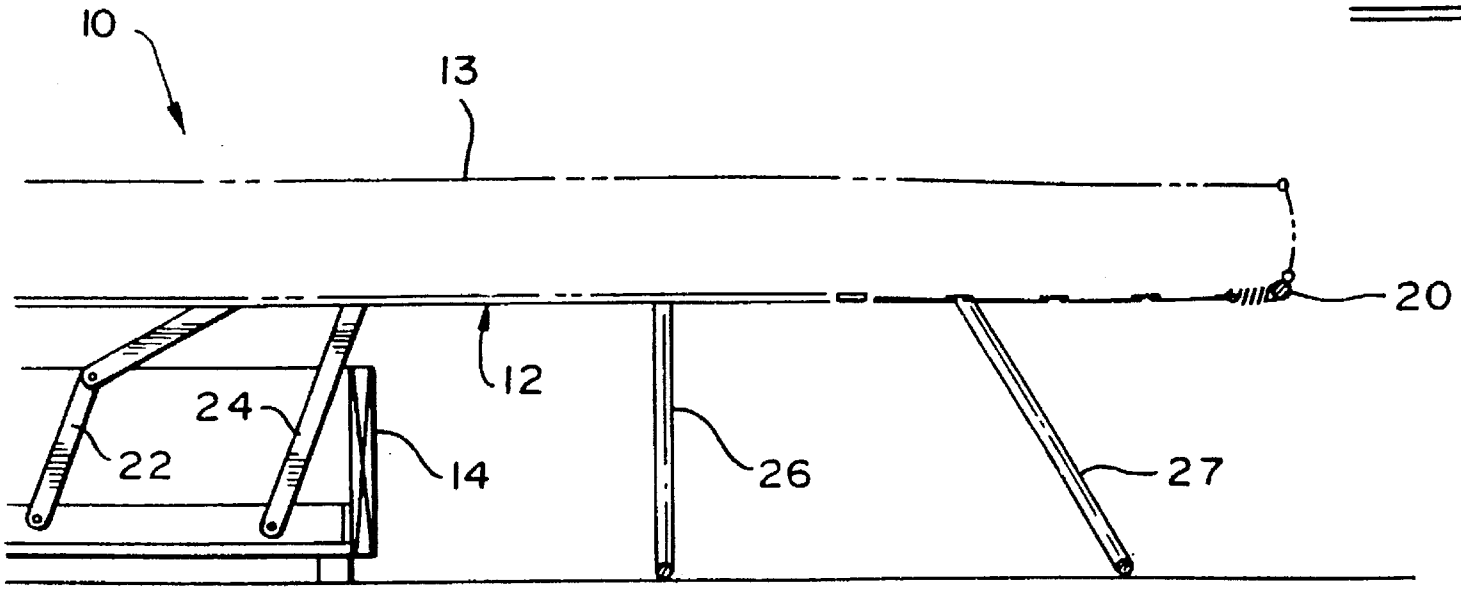
FIG. 1 is a side elevational view of a sofa bed in open position and incorporating a deck constituting a preferred embodiment of the present invention.
Figure 2:
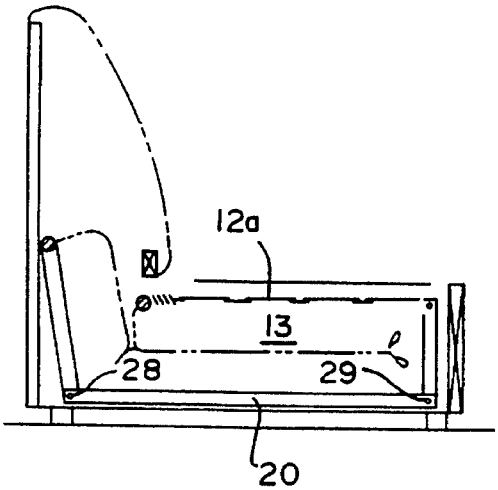
FIG. 2 is a side view of the sofa bed of FIG. 1 with portions removed to show internal parts.
Figure 5:
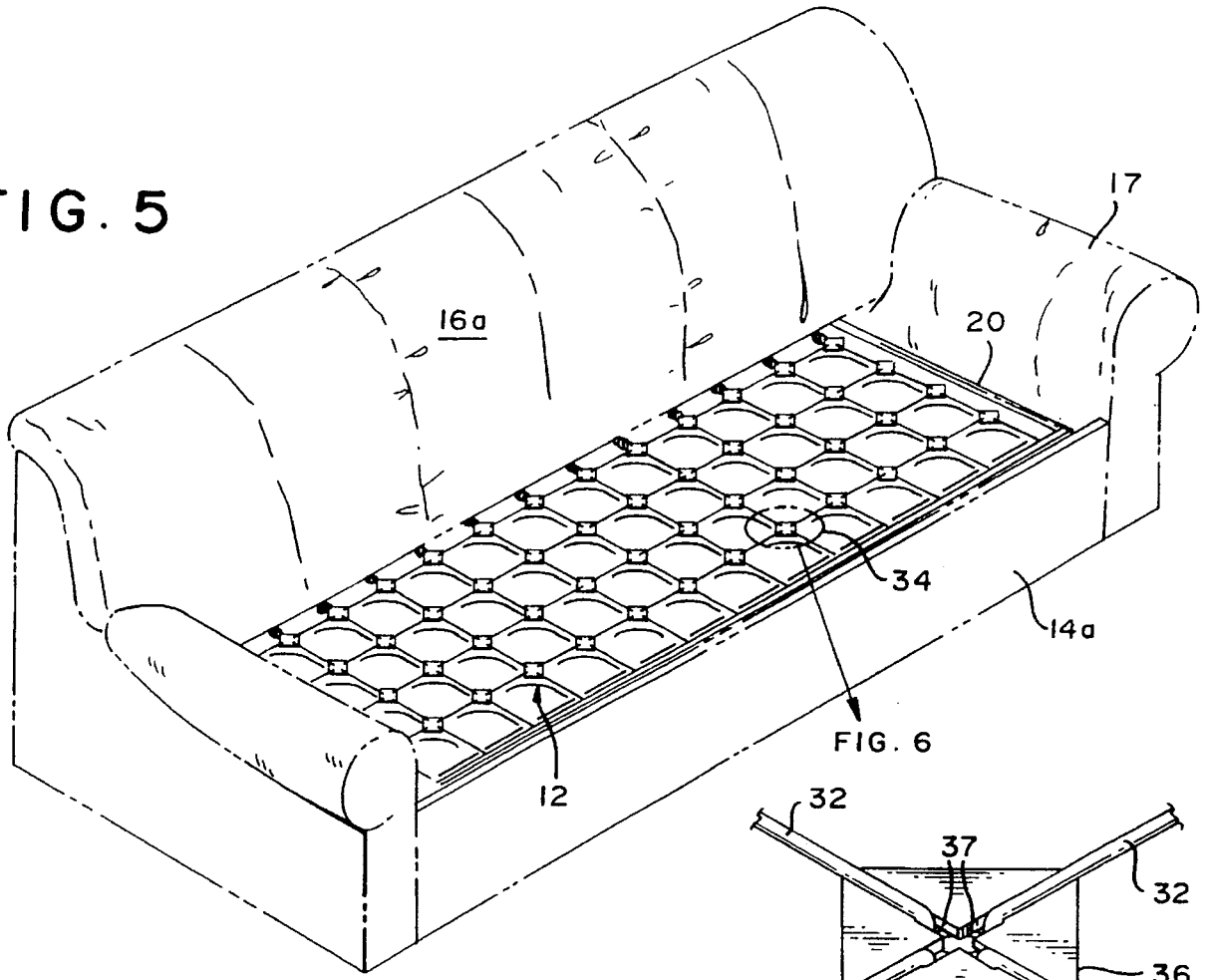
FIG. 5 is an enlarged perspective view of the sofa bed while in the sofa mode and with the cushions removed to show portions of the deck.
Figure 6:
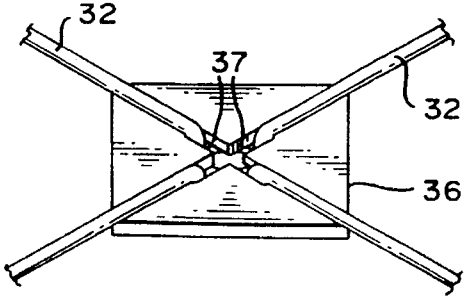
FIG. 6 is an enlarged fragmental perspective view of a portion of the bottom side of the deck when in the folded inverted position of FIG. 5.

Referring to the drawings in detail there is shown for illustrative purposes only in FIG. 1 a sofa bed generally designated 10 incorporating a support deck generally designated 12 in accordance with the present invention for supporting a mattress 13 for movement between a bed position shown in FIG. 1 and a sofa position shown in FIGS. 2 and 5. Sofa bed 10 may have a conventional frame structure including a backrest frame 16 upstanding from a base frame supported on the floor by legs 18, and a front rail 14. The aforementioned frame defines a cavity for receiving the sofa bed in the sofa position shown in FIG. 2 and for allowing the bed to be unfolded from the sofa position into the bed position shown in FIG. 1. Any conventional sofa bed frame may be utilized in conjunction with the deck of the present invention. In addition, the deck may be mounted to the frame by any suitable linkage shown for example at 22 and 24 for movement between the sofa and bed positions mentioned above. In addition, a conventional leg arrangement such as shown at 26 and 27 may be employed to support the deck in the bed position shown in FIG. 1 and yet at the same time to be foldable with the deck into the sofa position shown in FIG. 2. The mattress 13 itself may also be any conventional mattress although as will be apparent after reading the description below, the deck of the present invention will allow mattresses of greater depths to be employed than have been heretofore possible.

Figure 3:
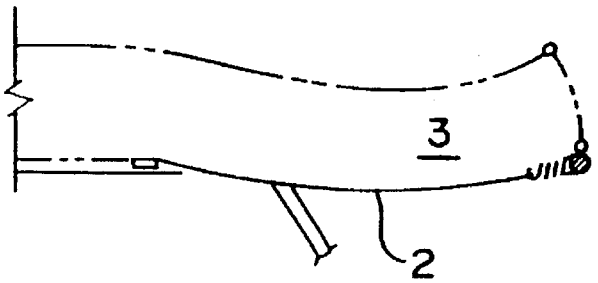
FIG. 3 PRIOR ART
FIG. 3 is a fragmental view of a mattress supported on a conventional deck and illustrating hammocking.
Figure 4:
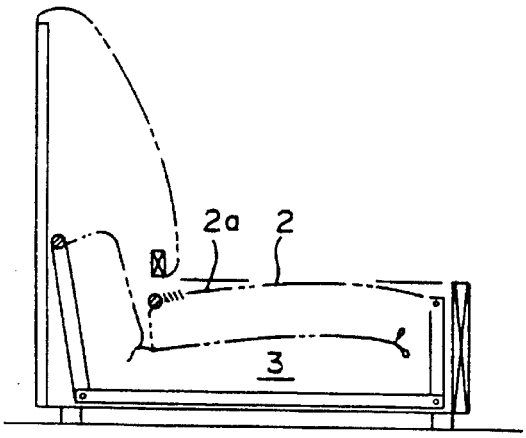
FIG. 4 PRIOR ART
FIG. 4 is a view generally similar to FIG. 2 but of a conventional sofa and deck illustrating the problem of "crowning"

FIG. 3 shows a conventional mattress 3 supported on a conventional deck 2 of the prior art and illustrates the problem of "hammocking" due to the fact that the deck 2 has insufficient strength to resist the weight of the mattress and an occupant of the mattress. FIG. 4 discloses the same conventional deck 2 when the sofa bed is in the folded or sofa position, and it is seen that due to the inadequate strength of the deck 2, the mattress 3 bulges upwardly to form a crown with a convex plane or surface 2*a*. As noted above, the sofa bed cushions cannot lie flat on a crowned surface. This provides both an unsightly appearance and an uncomfortable seat.

Figure 7:
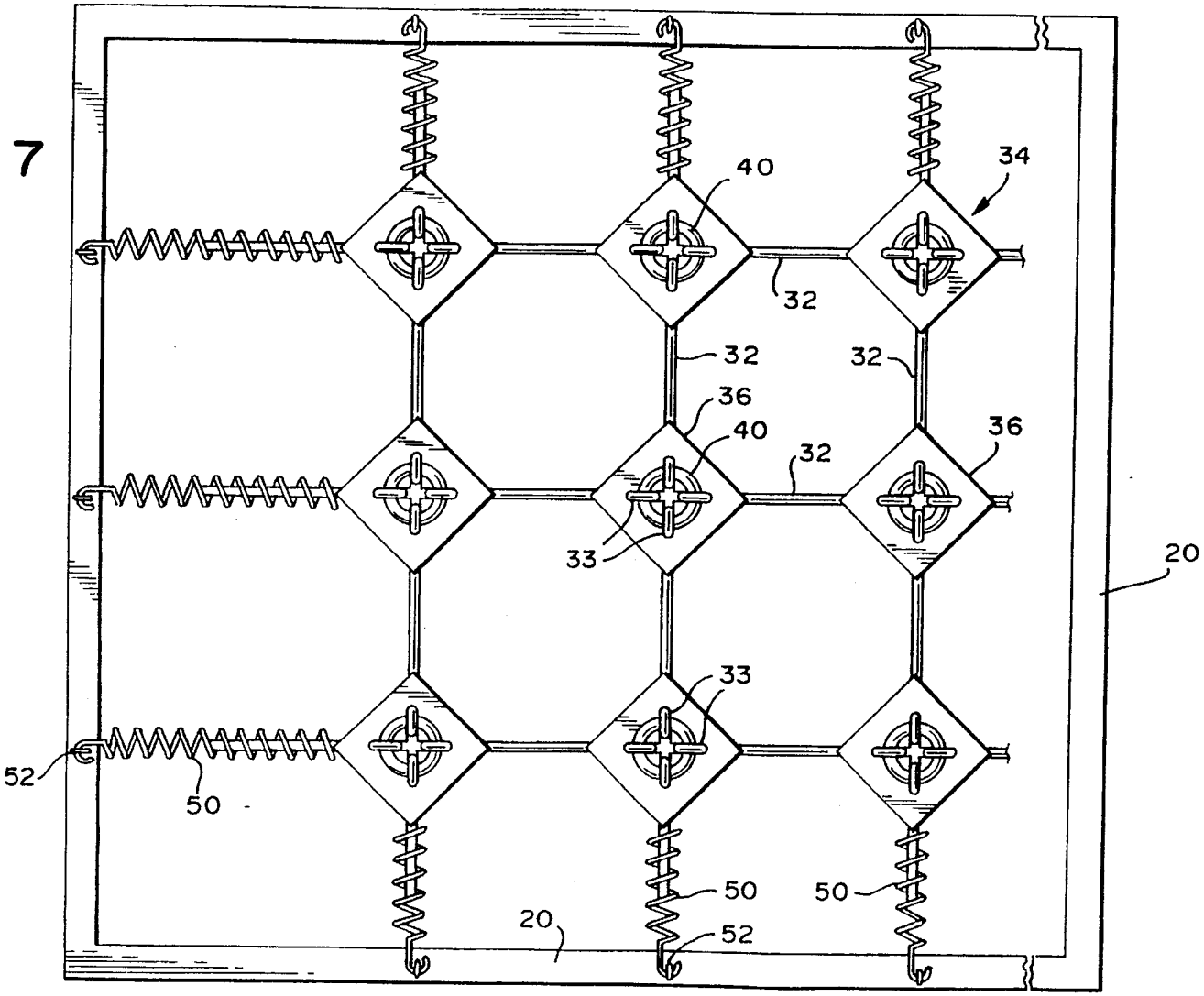
FIG. 7 is an enlarged plan view of the deck with portions broken away showing the upper side of the deck as seen when the sofa bed is in the bed mode.
Figure 8:
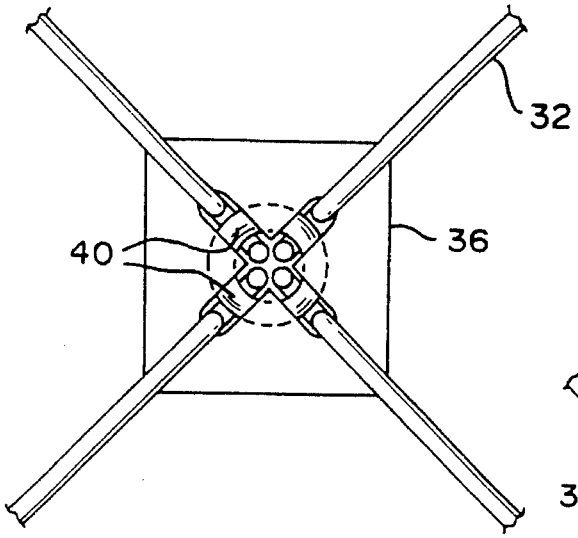
FIG. 8 is a fragmental plan view of a joint corresponding to the view shown in FIG. 6.
Figure 9:
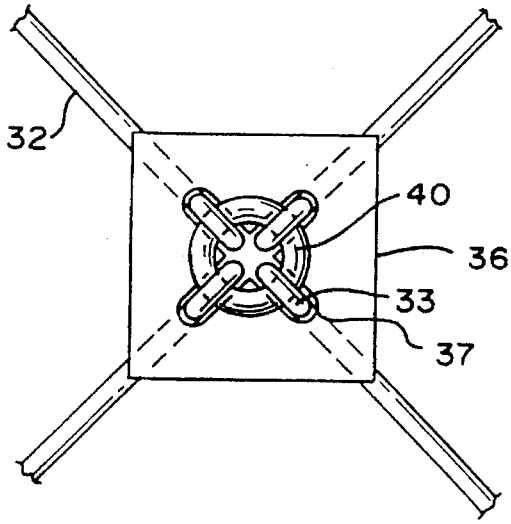
FIG. 9 is a plan view of the joint of FIG. 8 but as seen from the opposite side thereof.

The above problems are solved by the unique deck of the present invention which in the preferred embodiment may include any suitable perimeter frame 20 made from wood, tubular metal or any other suitable materials; the frame being shown as rectangular in FIG. 7. The deck includes a plurality of wire or wire-like members 32 which in the shown embodiment have descrete lengths of about 5¼ inches and are arranged in a grid which in the shown embodiment is a rectangular grid.

In accordance with the present invention, the adjacent ends of the wires 32 where their paths would intersect if extended, are connected by or through means which allow the wires 32 to yield or pivot when loaded or forced from one side but which will prevent the wires from pivoting or yielding when forced or loaded from the opposite side. The deck is arranged in the sofa bed such that when the sofa bed is in the bed position, the deck will not yield in a downward direction under the weight of the mattress or the occupant of the mattress but rather would provide a sturdy flat planar support structure. However, when the deck is moved into the sofa position and part of the deck at the remote end is folded with the mattress into the overlying position represented by 12*a* in FIG. 2, that portion of the deck will yield downwardly under the weight of the occupant of the sofa as is desirable to provide a soft and comfortable seat, but at the same time that portion of the deck will not be movable upwardly into a crowned or convex position under forces from the mattress, but rather will remain in a generally horizontal position as shown in FIG. 2. This not only provides a comfortable seating surface but also allows the sofa cushions to be placed on the deck so that they lie flat on the deck rather than "smile".

Figure 10:
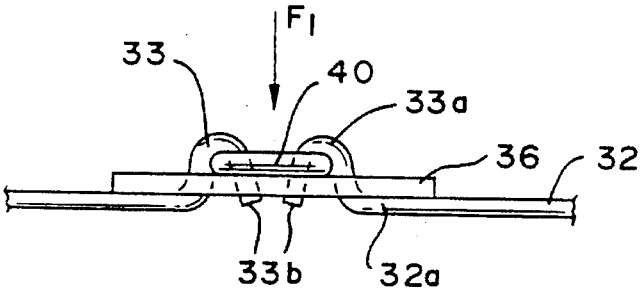
FIG. 10 is a cross-sectional view of the joint as shown in FIG. 9.

In one preferred embodiment of the invention, the deck wires 32 are joined by a connecting element 36 shown as a rectangular plate which is made from a suitable material such as steel and having a plurality of apertures respectively receiving the ends of the wires 32 which in the specific embodiment are shown as having hook shapes 33. Moreover, in the specific embodiment shown, the apertures in the connecting member 36 are formed by a cruciform aperture having four sections respectively receiving the hook portions 33 such that the straight portion 32*a* (see FIG. 10) of the wire is located on one side of the connecting plate 36 and a bite portion 33*a* is located on the opposite side of the connecting plate 36. The hook portions 33 of the wires 32 are retained in position relative to each other and to the connecting plate 36 by means of a retaining member which in the shown embodiment is a ring or ring-like structure 40 which is shown in FIG. 10 as lying on one side of the connecting plate 36. The bite portion 33*a* of the hooked ends 33 of the wires 32 are received about the retainer 40 and with the extremity 33*b* extending below the retainer 40 and through the cruciform slot 40 as shown in FIG. 10. It will thus be seen that if a force such as F1 in FIG. 10 is applied to the joint, the wires 32*a* will not pivot downwardly about the retaining rings 40. This orientation of the wires and their joints as shown in FIG. 10 is utilized for the bed position of the deck to provide a substantially rigid planar support surface for the mattress.

Figure 11:
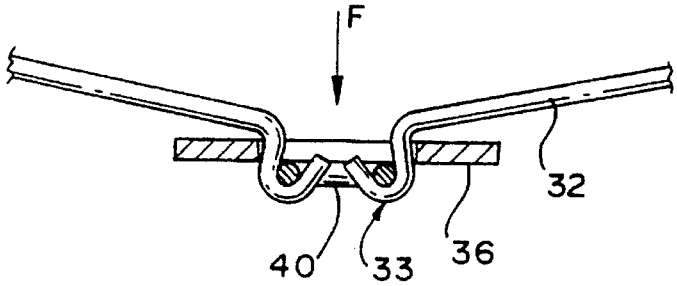
FIG. 11 is a view generally similar to FIG. 10 but with the joint in stressed condition.

Referring to FIG. 11, if a force F is applied to the joints from the side opposite the force F1 described above, it will be seen that the wires 32 will be free to pivot relative to the connecting plates 36 and the retaining ring 40 to allow the joints and the wires to yield, thus providing a soft comfortable seating surface when in the sofa position, shown for example in FIG. 5. In that position which is also shown in FIG. 2, the upper top layer 12*a* of the deck shown in FIG. 2 will be free to yield downwardly to provide a soft seat while the lower layer of the deck will be unyieldable to provide a substantially rigid planar support.

The wire grid of the deck of the present invention may be attached to the frame 20 in any suitable manner; one being shown in FIG. 7 where coil compression springs 50 have one of their ends 52 secured to the frame 20 while their other ends are received in one of the sections of the cruciform slots 37 of the connecting members. It should be understood that although a certain amount of flexability or yieldability in the grid structure will result from the elongation or flexing of the coil springs 50 upon loading, the joints of the wires 32 will still be relatively unyieldable when forces are applied in one direction as described above.

Figure 12:
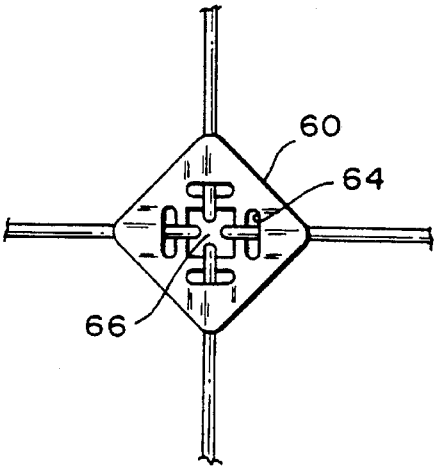
FIG. 12 is a plan view of a point in accordance with another embodiment of the present invention.
Figure 13:
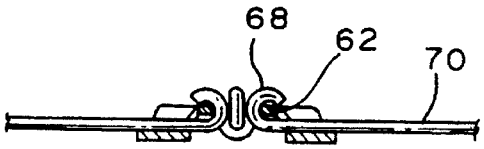
FIG. 13 is a cross-sectional View of the joint shown in FIG. 12.

Although one specific means for interconnecting the grid wires 32 to carry out the invention has been shown and described above, other means may be employed within the scope of the present invention. For example, with reference to FIGS. 12 and 13, a connecting plate 60 may be provided with upstanding portions 62 spaced from the plane of the plates 60 to provide apertures 64 which will receive the grid wires 70 with the hook portions 68 of the wires extending about the offset portions 62 as best shown in FIG. 13. Connecting plate 60 Would also be provided with a central aperture 66 through which the hooked wire portions 68 would extend. In addition to the connecting member 60 shown in FIGS. 12 and 13, other means may be employed including connecting the ends of the grid wires to each other directly.

In the specific embodiment shown and described, the grid wires 32 may be made from spring wire. In addition the retaining rings 40 may have a diameter of about ⅝ of an inch. Connecting plates 36 may be 1½ inch squares with slots 37 1¼ inches in length. Obviously other sizes and shapes may also be employed. The wire grid including the joints described above may extend throughout the length and width of the deck frame 20 or only a portion of the deck. The deck support of the invention may also be employed internally to form a support in a box spring. It may also be made without a foldable frame, that is, for a mattress or seat that does not fold as disclosed above.

Figure 15:
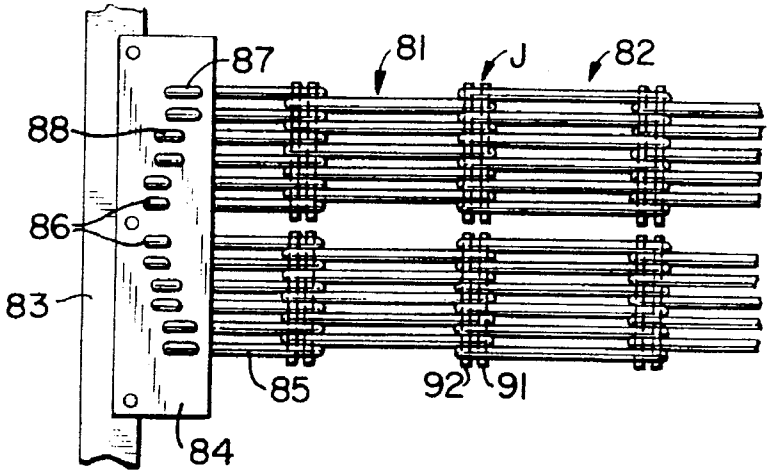
FIG. 15 is a plan view of the deck shown in FIG. 14.
Figure 14:
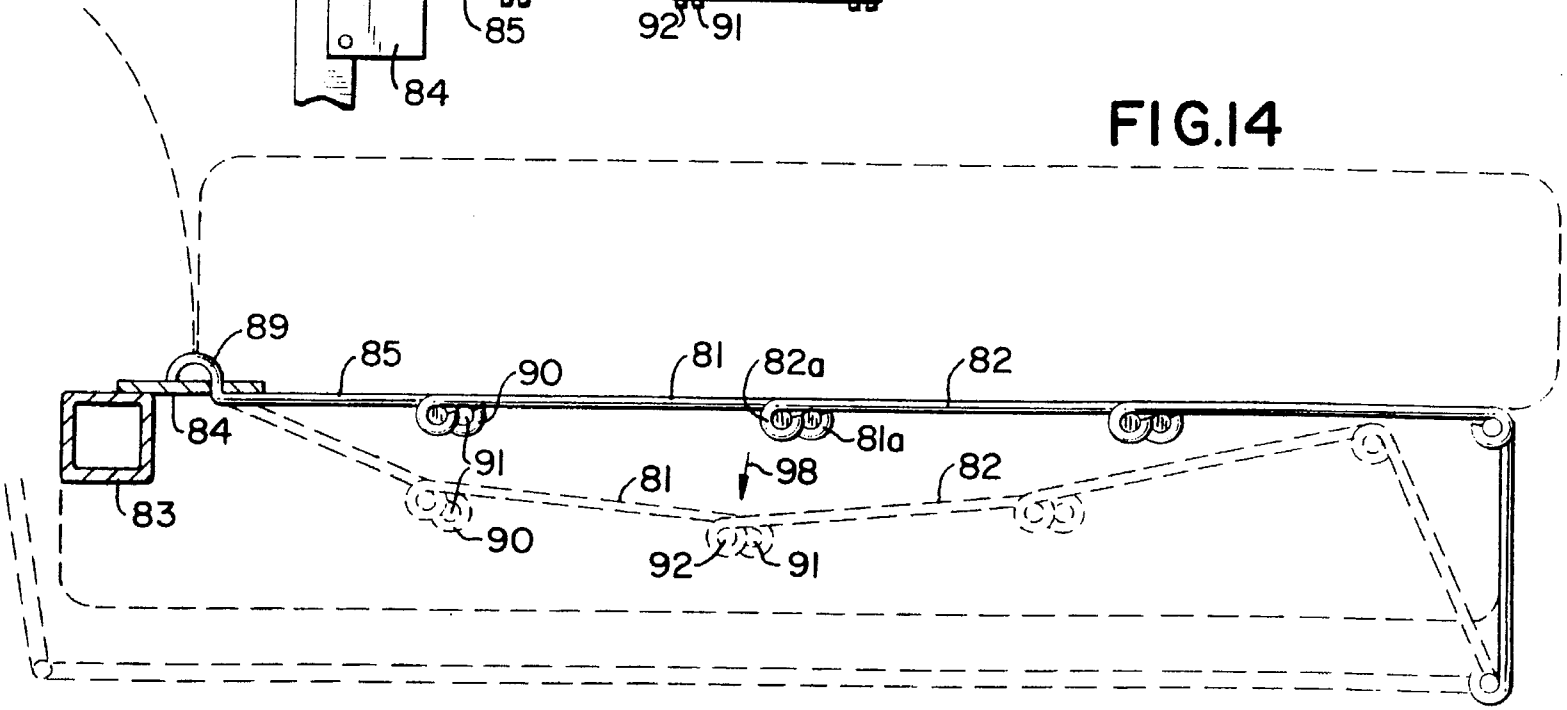
FIG. 14 is a cross-sectional view through a sofa bed incorporating another embodiment of the deck of the present invention.

Referring now to FIGS. 14 and 15 there is shown a support deck constituting another embodiment of the present invention including a plurality of elongated support members which may be wire-like or rod-like members 81 and 82 of any suitable material such as steel rod or spring steel. In the preferred embodiment the support members extend in the same general direction in a plurality of rows between the head and foot ends of the support frame 83 to which they are connected by any suitable means such as helical coil springs not shown. However in the preferred embodiment shown in FIGS. 14 and 15 they are connected to the frame by links 85 received in a mounting bracket shown as a plate 84 fixed to the frame 83. Bracket 84 has a series of apertures provided at predetermined locations several of Which are offset from each other to control tension in the support members so that they are in uniform tension across the deck. Note from FIG. 15 that the apertures 86 in the central area of the bracket 84 are offset outwardly of the frame relative to the other apertures while the end apertures 87 adjacent the opposite sides of the frame are positioned inwardly of the intermediate apertures 88 which are positioned inwardly of central apertures 86. Links 85 have their opposite ends formed with hook portions, one being 89 received in an aperture of the bracket 84 and the other being 90 received about a pivot 91 of an outermost support member 81 or 82 as shown in FIG. 14.

Figure 16:
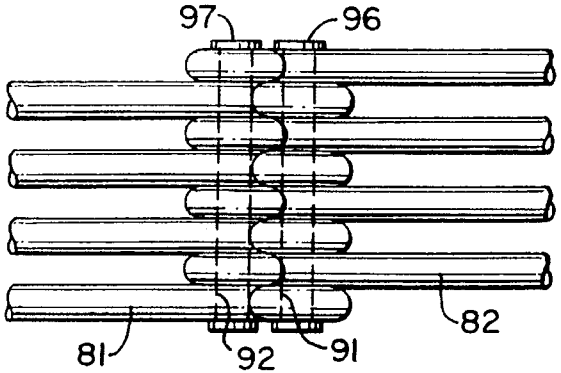
FIG. 16 is a fragmental plan View of a joint included in the deck of FIGS. 14 and 15.
Figure 17:
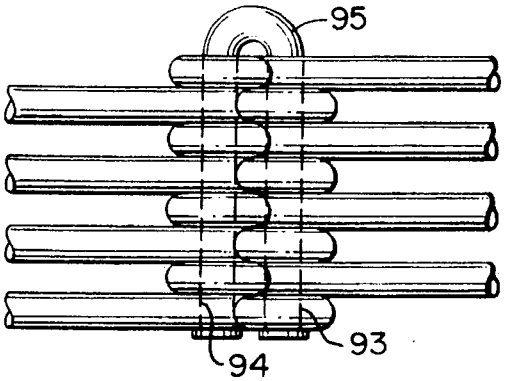
FIG. 17 is a fragmental plan view similar to FIG. 16 but showing a modification of a pivot pin that may be also employed in the embodiment of FIGS. 14 and 15.

The support members are provided in groups which are interconnected at joints generally designated J. In the shown embodiment the group 81 and the group 82 of support members each includes a plurality of support members, the specific number of which may vary depending on the size of the deck and load to which it will be subjected. Each of the joints J in this embodiment includes at least two pivots which in the embodiment of FIG. 16 is provided by separate pivot pins 91 and 92 and in the embodiment of FIG. 17 is provided by the opposite legs 93 and 94 of a U-shaped pivot member 95. Returning to FIGS. 14–16, support members 81 are mounted on pivot 91 for pivotal movement about pivot 91 while support members 82 are mounted on pivot 92 for pivotal movement about pivot 92. In the preferred embodiment of the support members shown, the opposite ends of the support members are each provided with an aperture shown as being formed by bending the opposite ends **81*a* and 82*a* of the support members 81 and 82 into loops. Pivot pins 91 and 92 are received in the loops and retained therein by enlarged heads 96 and 97 formed on the opposite ends of the pivot pins as shown in FIG. 16**.

In order to interconnect or link the groups 81 and 82 to form the joints J, the end loops **81*a* and 82*a* of each group are positioned between the end portions of the adjacent group 82 and 81 respectively with their pivot pins 91 and 92 located inwardly of the ends of the adjacent group such that the pivot pins of one group are captured by the support members of the adjacent group. Note that the pivot pins 91 and 92 of each joint lie in generally the same plane on one side of the straight body portions of the support members 81 and 82. It will thus be seen that although the support members 81 and 82 are free to pivot about their respective pivot pins when loaded in one direction as shown by the arrow 98 in FIG. 14 they will be prevented from pivoting in the opposite direction by the pivot pins 91 and 92 which will act as stops engaging the support members to limit movement. As illustrated in FIG. 14 the support members in the upper run of the deck will be yieldable downwardly When the cushion C is loaded to provide comfortable seating but at the same time will not bulge or move upwardly being the planar condition shown in FIG. 14 when unloaded thus holding the cushion C in the desired position shown in FIG. 14**.

Figure 18:
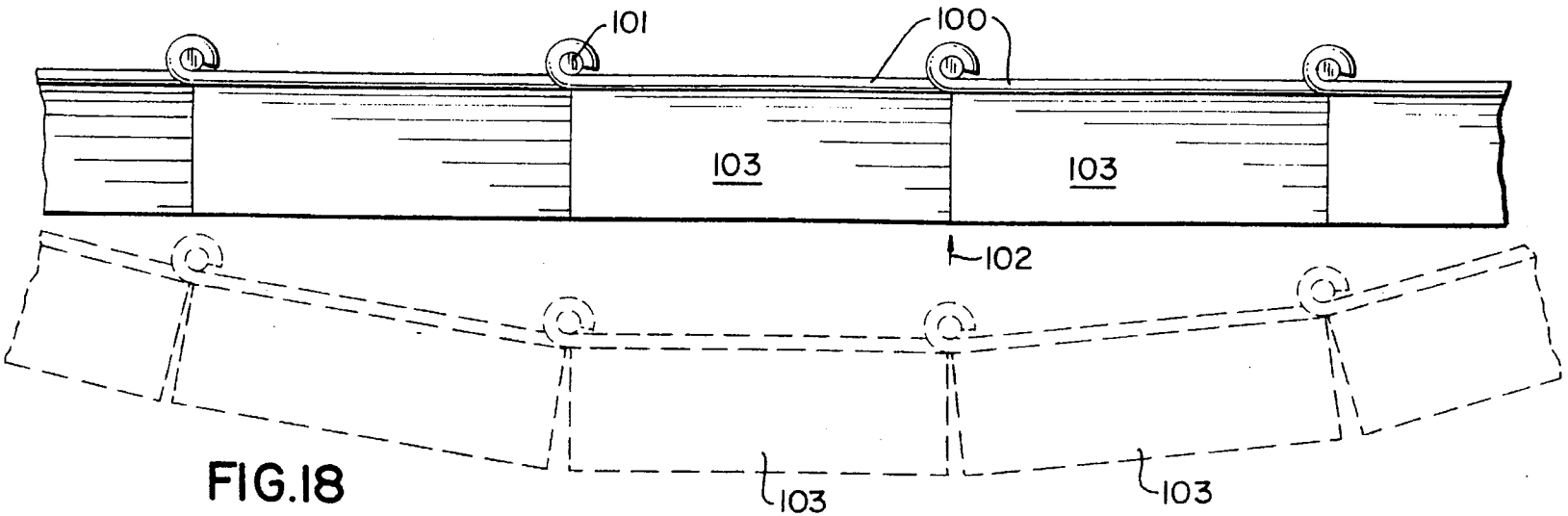
FIG. 18 is a fragmental side view of another embodiment of the deck of the present invention.

Referring now to FIG. 18 there is shown another embodiment of the present invention including a plurality of support members 100 extending in the same general direction between opposite end portions of the deck frame or border (not shown). The support members are connected or linked together at joints such as by pivot pins 101. In order to prevent or limit movement of the support members 100 in one direction when loaded in one direction by forces represented by the arrow 102 in FIG. 18, a plurality of stops 103 are formed or otherwise fixed on the support members 100 intermediate their ends to be engageable with each other as shown in FIG. 18 when the support members are loaded in one direction. However when the deck is loaded in the opposite direction, the support members 100 will be free to yield and move in that direction due to the spacing between the stops 103 shown in phantom lines in FIG. 18. Stops 103 may be made from wood, plastic or any other suitable material formed separate from or integral with the support members 100. Similarly the support members 100 may be formed in any suitable manner.

Figure 20:
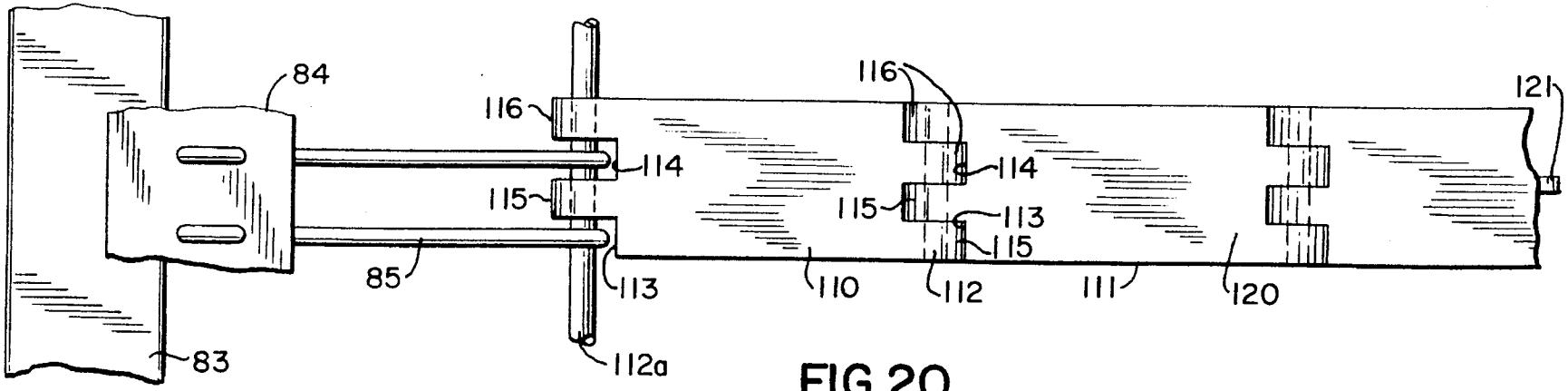
FIG. 20 is a plan view of the deck shown in FIG. 19.
Figure 19:
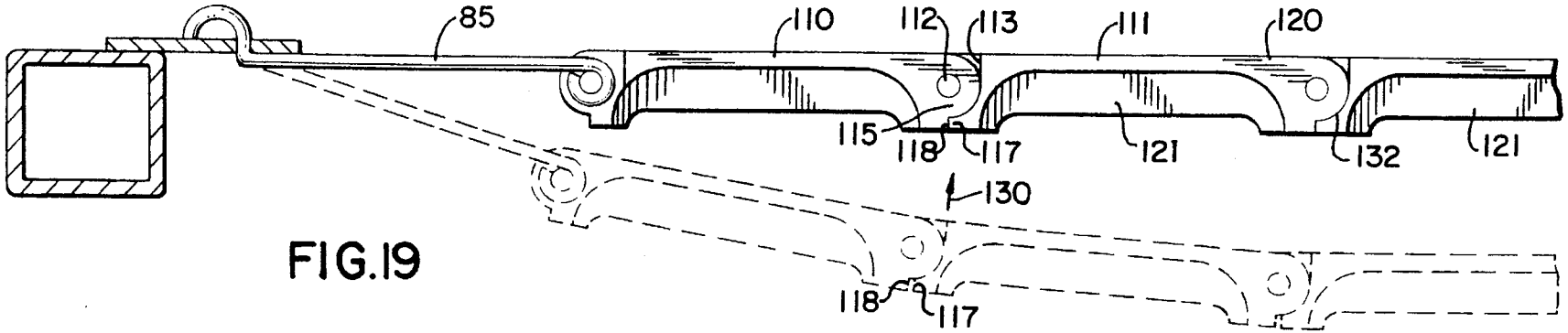
FIG. 19 is a cross-sectional view of a preferred embodiment of the deck of the present invention.

Referring now to FIGS. 19 and 20, there is shown a preferred form of the invention wherein the support members 110 and 111 are linked together by pivot pins 112 in the opposite ends thereof which have recessed portions 113, 114 for accommodating the adjacent projecting end portion 115 and 116 of the neighboring support member. In this embodiment the projecting end portions 115 and 116 are formed as a hinge barrel for receiving pivot pins 112 for pivotally linking the support members together. Pins **112*a* are provided for receiving links 85 which connect to the frame 83 via bracket 84 described above. Referring to FIG. 19, the recessed end portions 113 and 114 terminate at a stop surface 117 which is engageable with a projecting stop surface 118 formed on the adjacent end portions 115, 116 to limit relative pivotal movement between the support members 110, 111** about pivot pin 112 in one angular direction when subjected to forces represented by the arrow 130 in FIG. 19. The support members however 110, 111 are free to pivot relative to each other in the opposite angular direction as illustrated by the phantom lines in FIG. 19.

In the preferred form of the embodiment, the cross-section of the recessed portions 113, 114 is arcuate as indicated at 132 to complement and provide a seat for the arcuate surface of the mating end portion 115, 116 of the adjacent support member. Moreover it is preferred that the support members 110, 111 be extruded as an integral piece from a suitable plastic. It is further preferred that the support members have a generally flat elongated rectangular surface on one side 120 which will receive a seat cushion when the deck is folded in the sofa mode when in use in a sofa bed as shown in FIG. 19. The underside of each support member is provided with an integral reinforcing rib 121 extending longitudinally along the axis from end to end as best shown in FIG. 20. In the sofa mode position of the support members, a substantially continuous planar surface 120 will be presented to the cushions of the associated sofa bed and yet the support members will be yieldable downwardly to provide comfort and unyieldable upwardly to prevent crowning.

In a modification (not shown) of the embodiment shown in FIGS. 19 and 20, the opposite ends of the support members are not bifurcated as shown in FIG. 20 but instead have a single recess 113 and a single projection on each end which receive a mating projection and recess on an adjacent end.

It will thus be seen that in all of the various embodiments described above support members are pivotally interconnected to allow relative movement in one annular direction but stops are provided to prevent or limit movement in the opposite or counter direction. In the embodiment of FIGS. 5 through 11 the stops are provided by the plates 36 including the retaining rings and the support wires engageable therewith. In the embodiments of FIGS. 14–17 the stops are provided by the pivot pins and the support members engageable therewith while in the embodiment of FIGS. 18–20, the stops are provided by engageable surfaces on the opposite ends of the support members.

Figure 21:
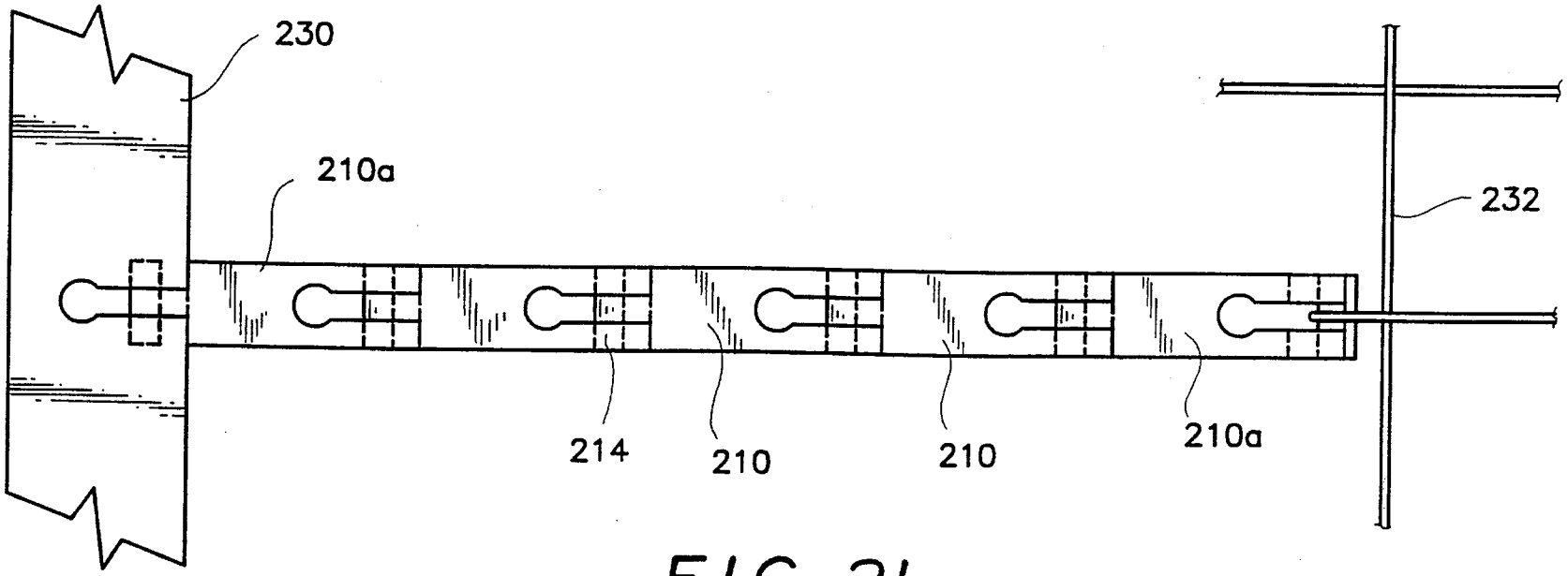
FIG. 21 is a fragmental plan view of a portion of another support deck constituting a preferred embodiment of the invention.
Figure 22:
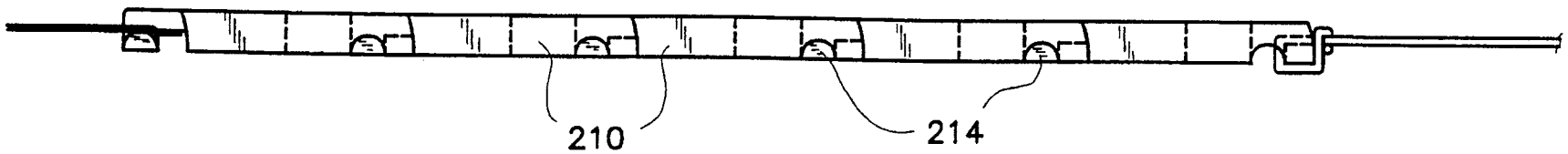
FIG. 22 is a side elevational view of the support deck shown in FIG. 21.
Figure 23:
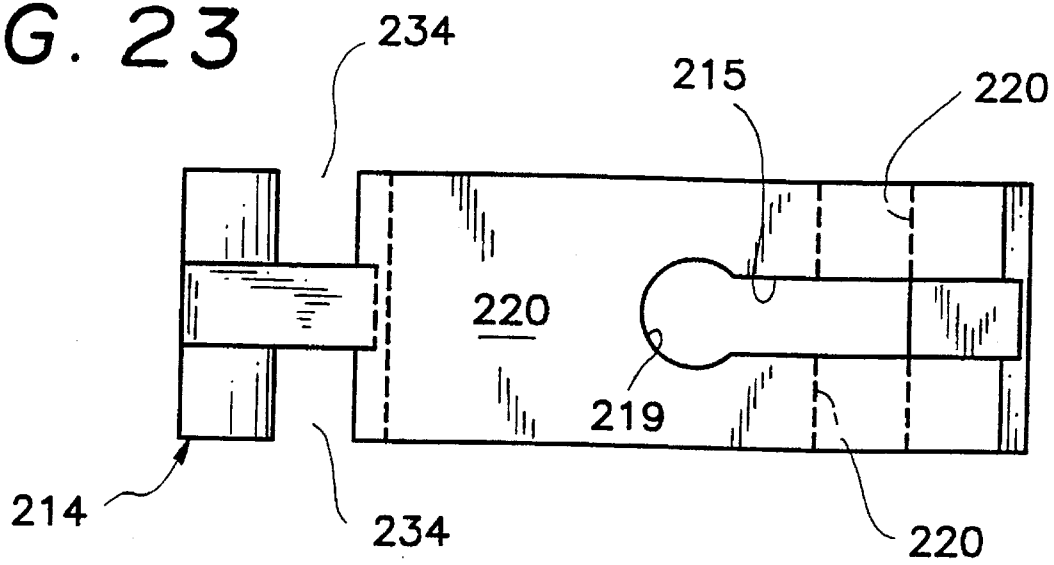
FIG. 23 is an enlarged plan view of one of the support members included in the support deck of FIG. 21.
Figure 24:
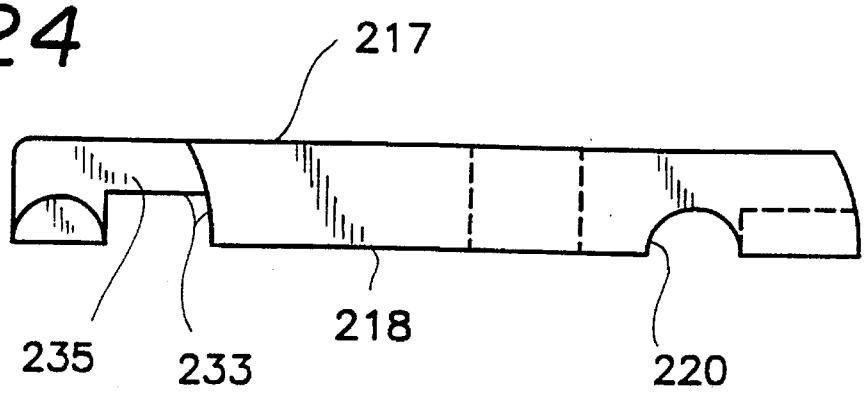
FIG. 24 is a side elevational view of the support member shown in FIG. 23.

Referring now to FIGS. 21 to 24, there is shown another preferred embodiment of the deck of the present invention. In this embodiment the support member 210 has a generally T-shaped projection 214 on one end and an elongated longitudinally-extending slot 215 in the opposite end portion as shown in FIG. 23. Slot 215 extends between the upper and lower surfaces 217 and 218 of the support member and in the specific form shown has an enlarged portion 219 at one end thereof. The underside of each support member has transverse passages 220 aligned across the slot 215 receiving the T-shaped projection of the adjacent support member as shown in FIGS. 21, 22. Transverse passages 220 communicate with the slot 215 and also open into the underside 218 of the support member. Slot 219 is made sufficiently large to allow the T-shaped projection 214 of the adjacent support member to be passed through the slot, then turned and then pulled axially into place in the transverse passage 220 as shown in FIG. 22. Each support member is recessed in the underside thereof as shown at 233 and on opposite sides at 234 thereby defining a neck 235 bridging T-shaped portion 214 with the main body. Neck 235 extends over the end portion of the adjacent support member. The support members 210*a* at opposite ends (see FIG. 21) of each row of support members 210 may be connected or attached to border members 230 and 232 as shown in FIG. 21. In other embodiments not shown, the support members may be enclosed within a mattress or attached to a mattress core to be enclosed in suitable upholstery.

The support member 210 is free to pivot in one direction about an axis through the T-shaped projection 214, however they will be limited in their pivotal movement in the opposite direction by engagement of the T-projection 214 with the body of the support member 210 located above the transverse passage 220 which body forms a stop.

The support members 210, 212 may not only be connected to a perimeter or border member to form a deck as described above, they may also be used within a mattress where they may be connected to the coils of the mattress and/or the fabric covering or any other member included in the mattress for holding and positioning the support members in rows, preferably parallel rows side to side or end to end of the mattress. If the support members are made from strong, heavyweight material they could be positioned on the underside of a mattress core prior to upholstering the mattress core. In this case, the rows of support members 210 would not need to be tensioned. Such a mattress could be placed on a conventional link, fabric or polypropylene deck where it would resist hammocking and fold flat while providing a comfortable seating or sleeping cushion. Alternatively, such a mattress could have its base attached to a perimeter frame thereby eliminating a separate deck altogether.

Although Applicant has shown and described specific embodiments of the invention, various modifications will become apparent to those skilled in the art but without departing from the scope of the present invention which is indicated in the appendant claims.

I claim:

1. In a sofa bed having a support frame movable between a folded position for sofa use and an unfolded position for bed use, said support frame including a deck for supporting bedding, said deck having an end portion adapted to overly bedding when the support frame is in the folded position and to underly bedding when the support frame is in the unfolded position, said deck end portion being yieldable in a downward direction and relatively unyieldable in an upward direction when the support frame is in the folded position, said deck end portion including a plurality of support members pivotally connected to each other and having means for limiting movement of said members in said upward direction when the support frame is in the folded position, said support members being supported by opposite portions of said support frame located outwardly of the support members and wherein there is further included connecting members interconnecting said support members and said opposite portions of said support frame.

2. The sofa bed defined in claim 1 wherein said support members are provided in a plurality of rows laterally positioned relative to each other with each row including a plurality of said support members supported by opposite portions of said support frame.

3. A support assembly for seating or bedding comprising a plurality of support members extending in the same general direction to form a support, said support members having adjacent ends connected to each other for pivotal movement relative to each other, means preventing movement of said ends in one direction and allowing pivotal movement of said ends in a direction opposite said one direction, said support members being provided in a plurality of rows laterally positioned relative to each other, each support member having a top wall and a passage below the top wall, each support member having a recess in at least one side thereof defining a neck portion of reduced dimension, each support member further having a slot in the top wall dimensioned to receive during assembly said neck portion of an adjacent support member, and wherein each support member has a portion projecting laterally from the neck portion and received in said passage and below the top wall of an adjacent support member.

4. The support assembly defined in claim 3 wherein said portion projecting from said neck portion is engageable with said top wall of an adjacent support member to limit pivotal movement in one direction.

5. The assembly defined in claim 4 wherein said neck portion and said projecting portion together form a generally T-shape.

6. The assembly defined in claim 5 wherein each support member has side walls depending from the top wall and defining with said top wall a space below the top wall.

7. In a sofa bed having a support frame movable between a folded position for sofa use and an unfolded position for bed use, said frame including a deck for supporting bedding, said deck having an end portion adapted to overly bedding when the frame is in the folded position and to underly bedding when the frame is in the unfolded position, said deck end portion being yieldable in a downward direction and relatively unyieldable in an upward direction when the frame in the folded position, and wherein said support members are provided in a plurality of rows laterally positioned relative to each other and each row including a plurality of said support members supported by opposite portions of said support frame.

8. The sofa bed defined in claim 7 wherein each support member includes a plurality of wire-like members, and said support members are interconnected by pivots.

9. The sofa bed defined in claim 7 wherein said support members are interconnected by pivots.

10. The sofa bed defined in claim 7 wherein each support member has a part engageable with a part of an adjacent support member when the frame is in said folded position.

11. The sofa bed defined in claim 7 wherein said rows of support members are connected to said support frame at locations on the support frame offset from each other.

12. A support assembly for seating or bedding comprising a plurality of support members extending in the same general direction to form a support, said support members having adjacent ends connected to each other for movement relative to each other, means preventing movement of said ends in one direction and allowing movement of said ends in a direction opposite said one direction, said support members being provided in a plurality of rows laterally positioned relative to each other, and wherein each support member has on one end a generally T-shaped portion and an end portion opposite said one end including a slot dimensioned to receive during assembly the T-shaped portion of an adjacent support member, said support member being pivotable about an axis extending through the T-shaped portion such that said support members are pivotable relative to each other in one direction.

13. The deck defined in claim 12 wherein each of the support members has a passageway in an underside thereof receiving a T-shaped portion of an adjacent support member.

14. A support assembly for seating or bedding comprising a plurality of support members extending in the same general direction to form a support, said support members having adjacent ends connected to each other for movement relative to each other, means preventing movement of said ends in one direction and allowing movement of said ends in a direction opposite said one direction, said support members being provided in a plurality of rows laterally positioned relative to,each other and extending between opposite end portions of said assembly, said rows each including a plurality of said support members, and wherein each support member has on one end a generally T-shaped portion and an end portion opposite said one end including a slot dimensioned to receive during assembly the T-shaped portion of an adjacent support member, said support member being pivotable about an axis extending through the T-shaped portion, said support members each having a portion forming a stop engageable with a T-shaped portion of an adjacent support member to limit movement of said support member in said one direction.

15. The assembly defined in claim 14 wherein said T-shaped portions are located below top surfaces of the adjacent support members.

* * * * *